US009516897B1

(12) United States Patent
Sinclair, Jr.

(10) Patent No.: US 9,516,897 B1
(45) Date of Patent: Dec. 13, 2016

(54) SMOKING ARTICLE AND METHOD FOR A CIGAR OR CIGARILLO HAVING A LONGITUDINAL BORE FOR ADJUSTABLE DRAW

(71) Applicant: Daniel S. Sinclair, Jr., Mandeville, LA (US)

(72) Inventor: Daniel S. Sinclair, Jr., Mandeville, LA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 1114 days.

(21) Appl. No.: 13/623,166

(22) Filed: Sep. 20, 2012

Related U.S. Application Data

(60) Provisional application No. 61/536,674, filed on Sep. 20, 2011.

(51) Int. Cl.
*A24F 15/00* (2006.01)
*A24F 15/06* (2006.01)
*A24D 1/00* (2006.01)

(52) U.S. Cl.
CPC ..... *A24F 15/00* (2013.01); *A24D 1/00* (2013.01); *A24F 15/06* (2013.01)

(58) Field of Classification Search
CPC ..... A24F 15/06; A24F 15/00; A24D 1/00
See application file for complete search history.

(56) References Cited

U.S. PATENT DOCUMENTS 7,677,251 B2 * 3/2010 Barnes et al. ..... A24C 5/04 131/58
2010/0212677 A1 * 8/2010 Kang et al. ..... A24C 1/00 131/58
2010/0218777 A1 * 9/2010 Sinclair, Jr. et al. .... A24C 5/40 131/58

* cited by examiner

*Primary Examiner* — Michael H Wilson
*Assistant Examiner* — Dionne Walls Mayes
(74) *Attorney, Agent, or Firm* — Garvey, Smith, Nehrbass & North LLC; Brett A. North

(57) ABSTRACT

A smoking article provides a purchased, as-built cigar that can be disassembled to form multiple cigars, enabling a consumer to make his or her own cigars using custom tobacco filler. The as-built cigar is capped as part of its construction, preferably at one end or at both ends. A smoker removes the cap or caps to enable smoking of the as-built cigar or disassembly into layers. Each layer can then be rolled with a smoker's custom tobacco. The inner layer contains tobacco filler. Upon disassembly, the inner layer and tobacco filler can be smoked. Alternatively, the inner layer can be pulled apart at a provided serration to discard the tobacco filler and then filled and rolled with a smoker's custom tobacco filler material.

19 Claims, 16 Drawing Sheets

SMOKING ARTICLE AND METHOD FOR A CIGAR OR CIGARILLO HAVING A LONGITUDINAL BORE FOR ADJUSTABLE DRAW

CROSS-REFERENCE TO RELATED APPLICATIONS

This is a non-provisional of U.S. Provisional Patent Application Ser. No. 61/536,674, filed Sep. 20, 2011, which is incorporated herein by reference and to which priority is claimed.

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

The present invention relates to tobacco products, namely a cigar that enables a smoker or consumer to fabricate one or more custom cigars by disassembly of an original cigar, allowing the smoker or consumer to choose his or her own tobacco fill material for each custom cigar.

BACKGROUND

In recent years, smoking of cigars has become fashionable and numerous cigar shops have opened around the world to satisfy this growing trend. The variety, quality and size of ready-made cigars satisfy the majority of the public. However, a small segment of connoisseurs insist that nothing can compare with the taste and smell of custom-blended tobacco products. These knowledgeable individuals are very selective in the manner in which their cigars are rolled and in the grade of tobacco used.

A still smaller segment of cigar aficionados prefers to customize their own cigars by impacting the draw.

SUMMARY

The present invention provides a method of constructing an original or first cigar fabricated of a wrapper/binder and tobacco filler with at least one removable forma mandrel or straw to provide an inner bore for controlling the draw during smoking.

In one embodiment the method can include removing a first cigar (filled with tobacco filler) from a package, removing a form mandrel from such first cigar creating an interior longitudinal bore, and smoking such first cigar wherein the longitudinal bore controls the draw during smoking.

In one embodiment, instructions are provided on the packaging teaching the squeezing of the cigar or cigarillo in a direction substantially perpendicular to the longitudinal axis to decrease air flow though the longitudinal draw during smoking.

One embodiment, a form mandrel can be included in the first cigar such that the cross section will show a set of concentric circles, the innermost circle being the form mandrel, and the next annular area being the tobacco filler contained by a wrapper binder area. In different embodiments, the ratio of the radius of the form mandrel to the radius of outer circle for the annulus of tobacco filler is 1 to: 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, and/or 33. Various embodiments include possible ranges between any of the combinations of the above listed ratios. For example, between 1:3 and 1:20; 1:5 and 1:15, etc.

One embodiment provides various configurations of pre-rolled sheets can be provided on the cigar or cigarillo core. One embodiment includes a layered configuration of pre-rolled sheets including a first sheet of homogenized tobacco paper, a second sheet of natural leaf, and an inner core comprising a cigar or cigarillo. One embodiment includes a layered configuration of pre-rolled sheets including a first sheet of natural leaf, a second sheet of homogenized tobacco paper, and a an inner core comprising a cigar or cigarillo.

One embodiment, over an inner core comprising a cigar or cigarillo, includes a plurality of pre-rolled sheets numbering 2, 3, 4, 5, 6, 7, 8, 9, 10, 11, 12, 13, 14, 15, 16, 17, 18, 19, 20, 21, 22, 23, 24, 25, 26, 27, 28, 29, or 30. Various embodiments include possible ranges between any of the combinations of the above listed numbers. For example, between 3 and 20, 5 and 15, etc.

One embodiment includes sheets made of the same material, such as homogenized tobacco paper, natural leaf, rolling paper, and/or sheets of other smokable materials. One embodiment includes possible combinations of the different types of sheets of homogenized tobacco paper, natural leaf, rolling paper, and/or sheets of other smokable materials. One embodiment includes sheets comprised of different smokable materials chosen from any combination of the following types of materials: natural leaf, homogenized tobacco paper, pipe tobacco, different types of flavored tobacco, tea leaves, kanna, blue lotus, *salvia, salvia* eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, *Leonurus* Sibericus Flowers, Wild Dagga Flowers, Klip Dagga Leaf, Damiana, Hookah, *Hemia salicifolia*, Kava Kava, *Avena Sativa*, scotch broom topps, Valarian, capillarius, herba, Wild clip dagga, *Leonurus sibiricus*, Kanna, Sinicuichi, and/or *lactuca virosa.*

In one embodiment multiple types of filler material is included which offers the consumer the option of using different types of filler and/or blending between the types of filler included. In one embodiment different types of filler material can be chosen from any combination of the following types of filler material: pipe tobacco, different types of flavored tobacco, tea leaves, kanna, blue lotus, *salvia, salvia* eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, *Leonurus* Sibericus Flowers, Wild Dagga Flowers, Klip Dagga Leaf, Damiana, Hookah, *Hemia salicifolia*, Kava Kava, *Avena Sativa*, scotch broom topps, Valarian, capillarius, herba, Wild clip dagga, *Leonurus sibiricus*, Kanna, Sinicuichi, and/or *lactuca virosa.*

One embodiment includes a cigar tip which can be used with the finished tobacco products.

The method of the present invention thus enables an end user to make his or her own custom finished tobacco products with a selected, custom filler material/blend of filler material. The method preferably includes the use of a liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, piña colada, punch, purple, rum, strawberry/kiwi, vanilla, watermelon, wet cherry, and/or whiskey.

The flavors are preferably added to the form casings and/or pre-rolled sheets with a liquid. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

In one embodiment "pig-tailed" type ends can be formed by twisting overlapping sheets in a rope-like formation and then twisting this rope-like formation in a "pig-tailed" type shape. In one embodiment the overlapping sheet can be longer (i.e., overlapping) in a longitudinal direction in one or both ends of a tobacco product.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

FIGS. 1-6 show a preferred embodiment of the apparatus of the present invention designated generally by the numeral 5. FIGS. 1-6 also show a method of the constructing a cigar having at least one longitudinal draw passage through its tobacco filler.

Figure 1:
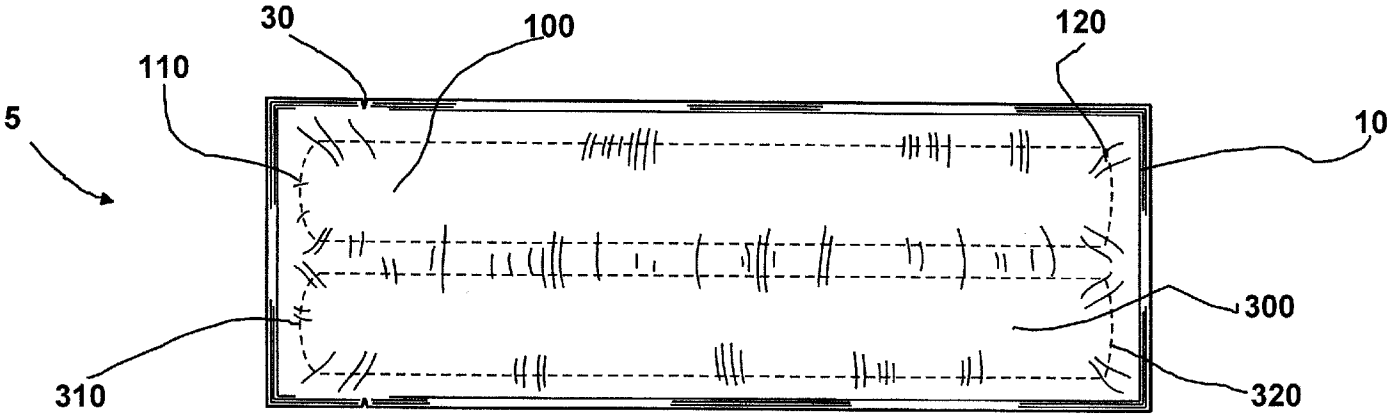
FIG. 1 is a top view of commercial packaging (e.g., foil pouch) containing two cigars or cigarillos each having a form mandrel or straw along its longitudinal centerline.

In FIG. 1, the cigar article 5 of the present invention provides a first cigar 100 which is a commercially available or as-built and packaged cigar 300 as purchased by a consumer or customer. First cigar 100 thus is contained in package 10 which can be a plastic, heat sealed or other package. Package 10 can provide a resealable closure 20 and a tear notch 30 for enabling access to the package interior 40. The resealable closure 20 can be sealed as manufactured to prevent contamination from moisture. Package 10 can thus have an interior 40 that is of a controlled environment upon manufacture. By tearing package 10 at tear notch 30, package 10 can be opened.

First cigar 100 provides end portions 110, 120, tobacco filler 200, and outer wrapper/binder 140. Inside tobacco filler 200 can be a form mandrel (e.g., straw 160) which can span the longitudinal length of cigar 100. When packaged cigar 100 can include form mandrel 160, surrounded by tobacco filler 200, and each of which are contained by outer wrapper/binder 140. FIG. 1 is a top view of commercial packaging (e.g., foil pouch) 10 containing two cigars or cigarillos 100,300 each having a form mandrel or straw 160 along its longitudinal centerline.

Figure 2:
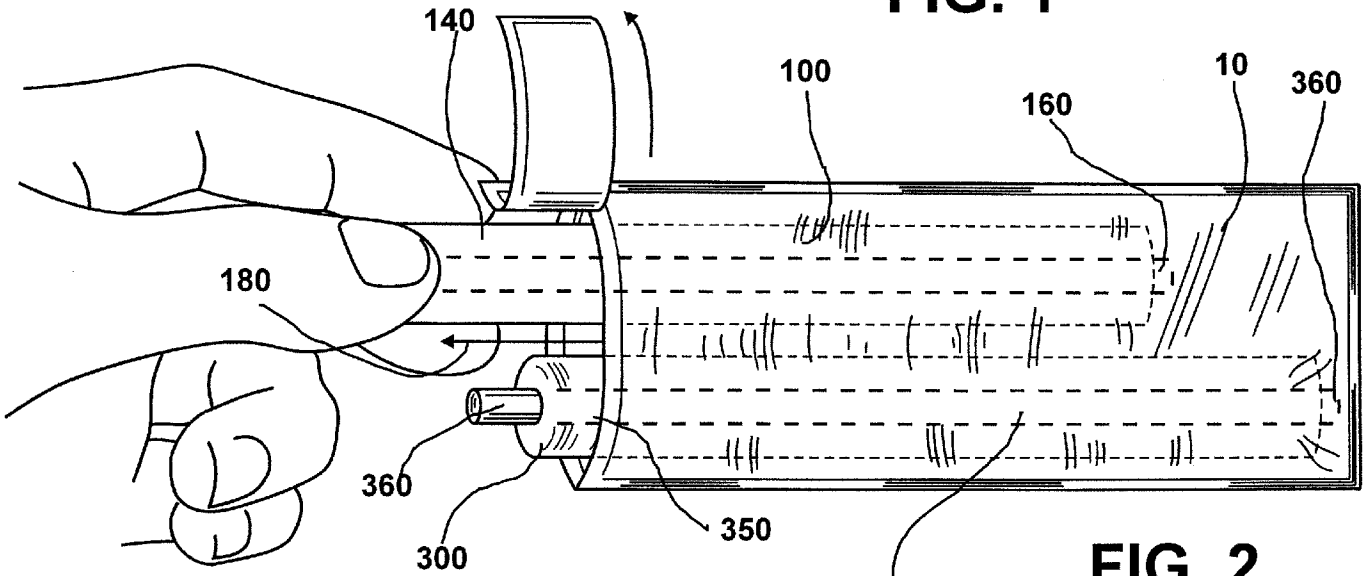
FIG. 2 shows the packaging of FIG. 1 in an opened condition and a user pulling out one of the cigars or cigarillos.
Figure 3:
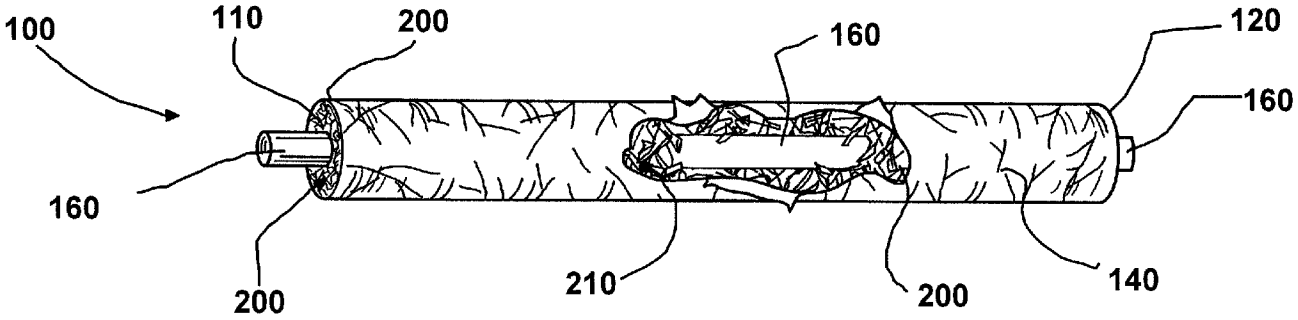
FIG. 3 shows one of the cigarillos of FIG. 1 removed from the packaging.
Figure 4:
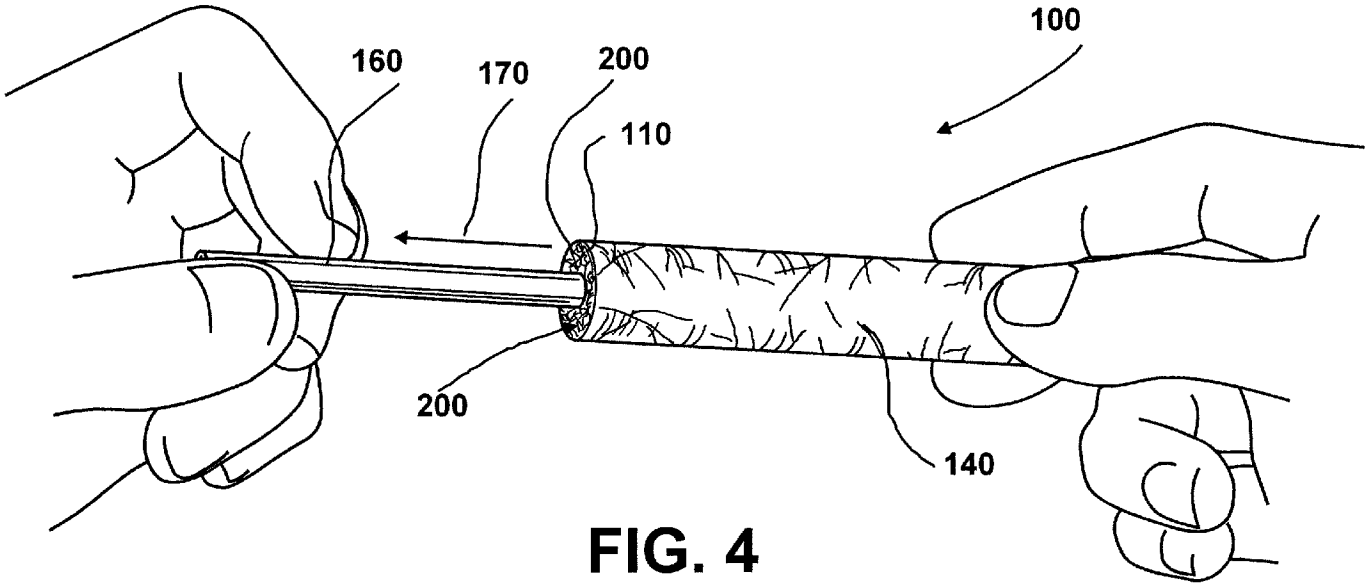
FIG. 4 shows the step of removing the straw from the cigarillo of FIG. 3.

FIG. 2 shows the packaging of FIG. 1 in an opened condition and a user pulling out one of the cigars or cigarillos (schematically indicated by arrow 180). FIG. 3 shows one of the cigarillos 100 removed from the packaging 10. Before smoking cigar or cigarillo 100 form mandrel 160 should be removed. FIG. 4 shows the step of removing the straw 160 from the cigarillo 100. Here straw 160 is grasped while cigar 100 is held and straw 160 is pulled in the direction of arrow 170.

Figure 5:
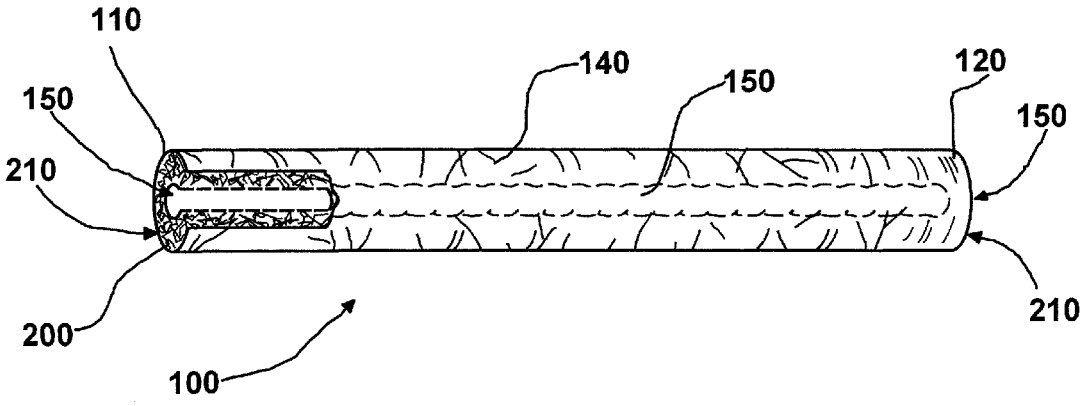
FIG. 5 shows the cigarillo with the straw removed.
Figure 6:
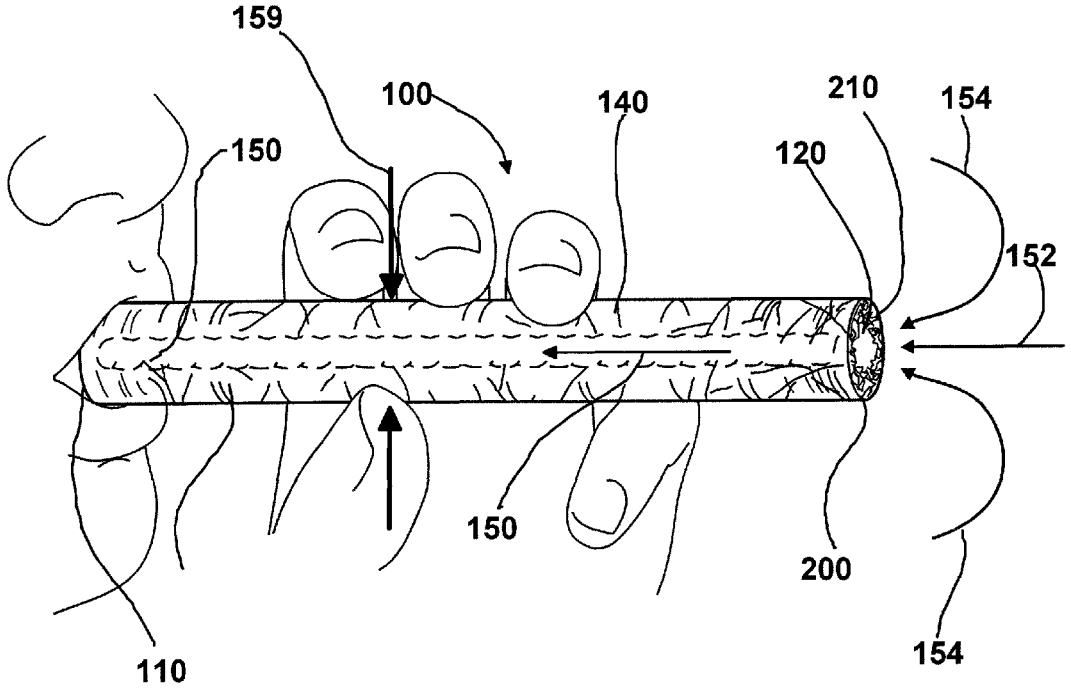
FIG. 6 shows the cigar or cigarillo lit with draw being impacted by the longitudinal opening.

FIG. 5 shows the cigarillo 100 with the straw 160 removed. Here, cigar or cigarillo 100 includes longitudinal bore 150 which is roughly the same size as straw or form mandrel 160. An annular area of tobacco filler 200 around bore 150 can be created which tobacco filler is held in place by wrapper/binder 140. FIG. 6 shows the cigar or cigarillo lit with draw being impacted by the longitudinal opening.

End 110 can be placed in consumer's mouth while end 120 can be lit. As consumer sucks in air is pulled into end 120 in both the longitudinal bore along with the annular tobacco area. The relative resistance to air flow between annular bore 150 and annular tobacco area 210 will determine the ratio of air flow in bore 150 to air flow in annular area 210 to impact the draw.

In FIG. 6 the relative resistance to air flow between annular bore 150 and annular tobacco area 210 can be changed be a user during smoking by squeezing on cigar (schematically indicted by arrows 159) which will tend to decrease at one point along the longitudinal length of cigar 100 the size of longitudinal bore 150 while the resistance of annular area of tobacco 210 will be increased only a small amount or not at all. In this way the user can impact the draw of cigar 100 by changing the ratio of air drawn from longitudinal bore (schematically indicated by arrow 152) relative to air drawn through annular tobacco area 210 (schematically indicated by arrows 154).

Packaging 10 can include directions to the consumer regarding:

(a) pulling out of form casing or mandrel 160; and/or (b) squeezing cigar or cigarillo 100 to impact the overall draw (and/or the relative draw between longitudinal bore 150 and annular tobacco filler area 210).

Figure 7:
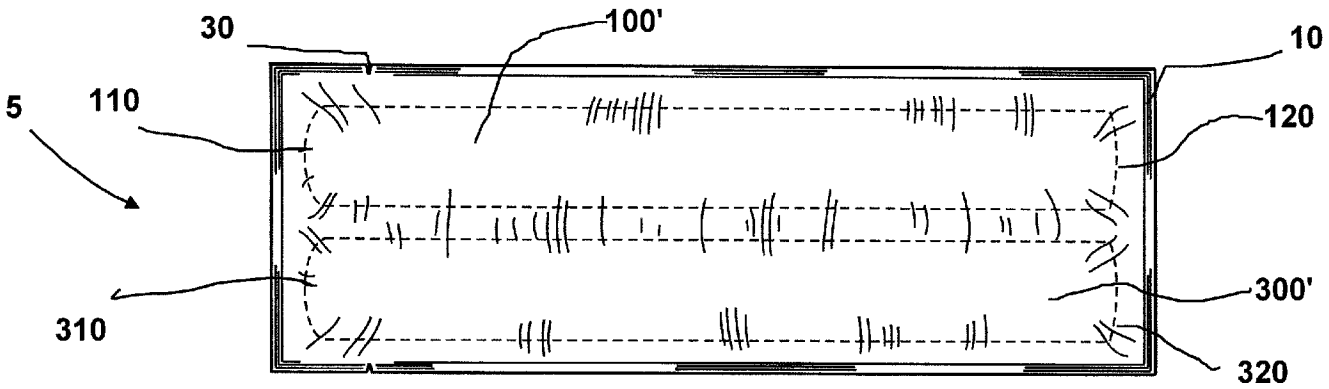
FIG. 7 is a top view of commercial packaging (e.g., foil pouch) containing two cigars or cigarillos each having a large sized pull cord along its longitudinal centerline.
Figure 8:
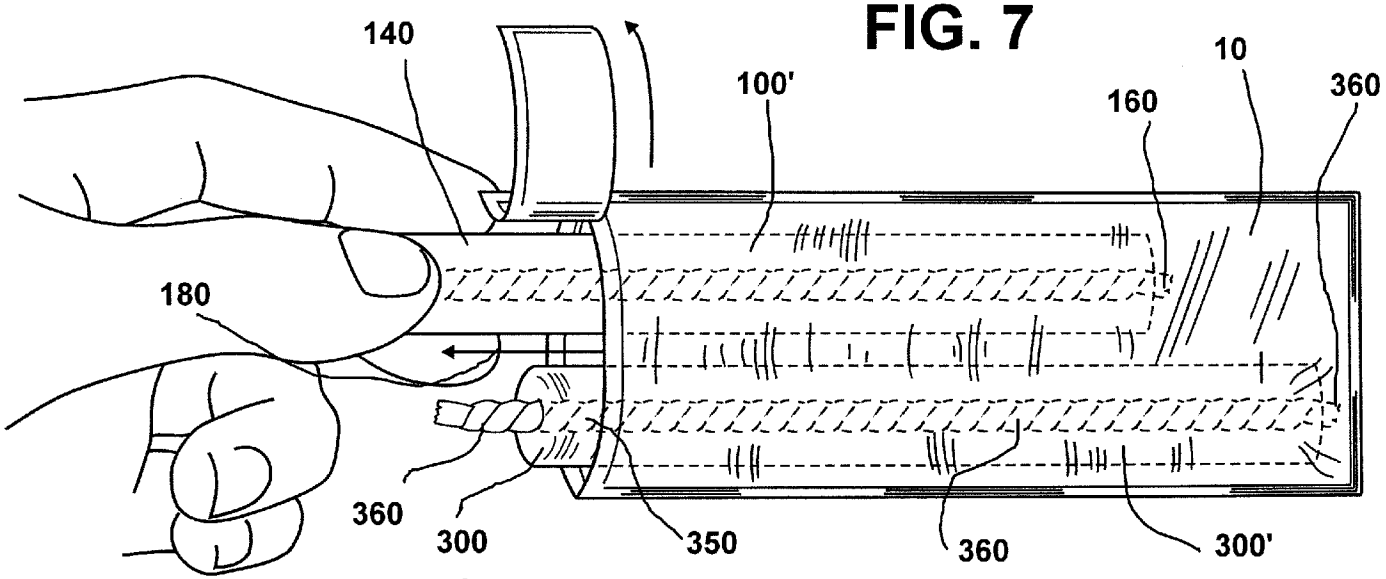
FIG. 8 shows the packaging of FIG. 7 in an opened condition and a user pulling out one of the cigars or cigarillos.
Figure 9:
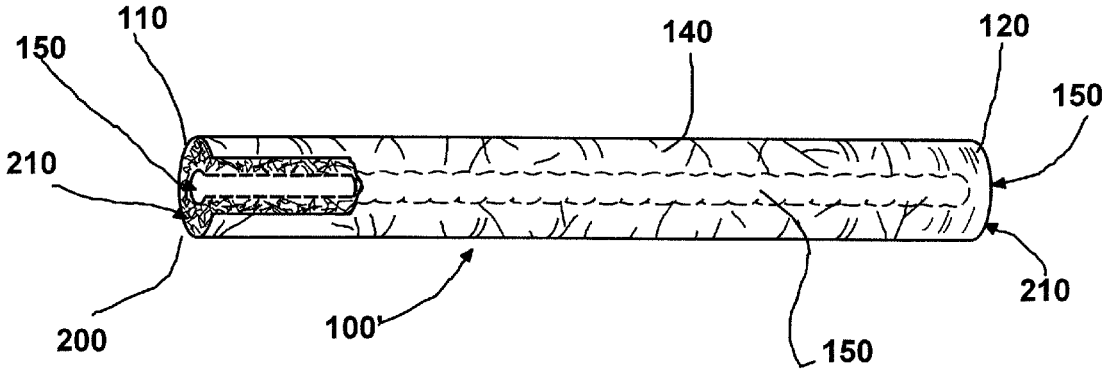
FIG. 9 shows one of the cigarillos of FIG. 7 removed from the packaging and having the large sized cord removed.
Figure 10:
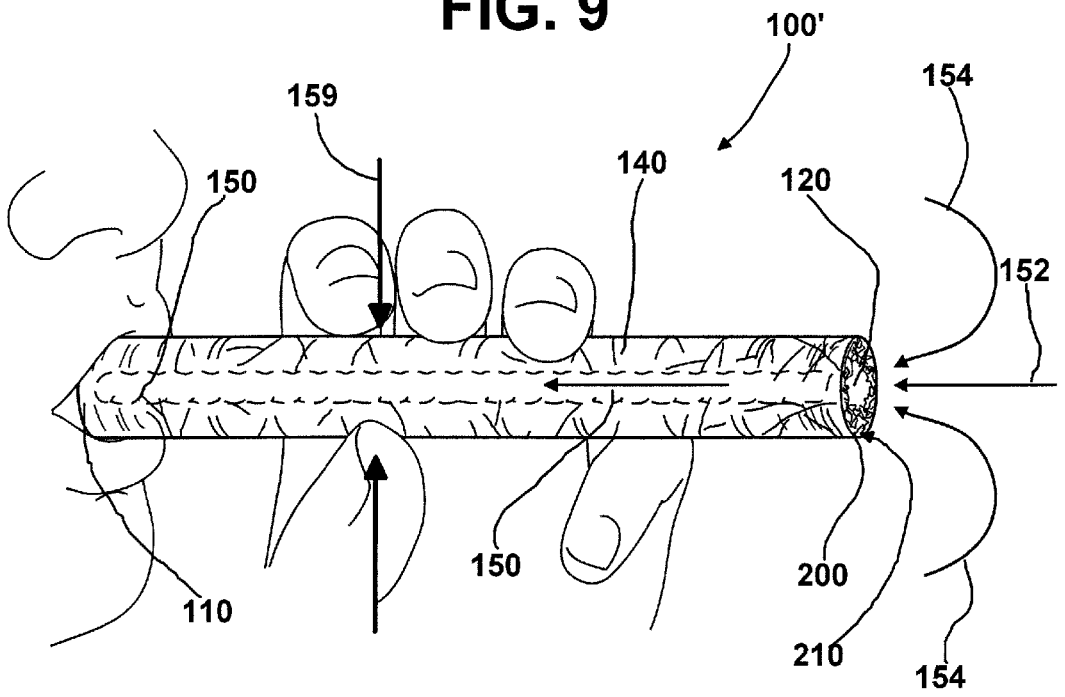
FIG. 10 shows the cigar or cigarillo lit with draw being impacted by the longitudinal opening after the large sized pull cord has been removed.

FIG. 7 is a top view of commercial packaging (e.g., foil pouch) containing two cigars or cigarillos 100', 300' each having a large sized pull cord 160 along its longitudinal centerline. FIG. 8 shows the packaging 10 in an opened condition and a user pulling out one of the cigars or cigarillos 100'. FIG. 9 shows cigarillo 100' now removed from the packaging 10 and having the large sized cord 160 removed. FIG. 10 shows the cigar or cigarillo 100' lit with draw being impacted by the longitudinal opening 150 after the large sized pull cord 160 has been removed.

In FIG. 10 the relative resistance to air flow between annular bore 150 and annular tobacco area 210 can be changed be a user during smoking by squeezing on cigar 100' (schematically indicted by arrows 159) which will tend to decrease at one point along the longitudinal length of cigar 100' the size of longitudinal bore 150 while the resistance of annular area of tobacco 210 will be increased only a small amount or not at all. In this way the user can impact the draw of cigar 100' by changing the ratio of air drawn from longitudinal bore (schematically indicated by arrow 152) relative to air drawn through annular tobacco area 210 (schematically indicated by arrows 154).

Figure 11:
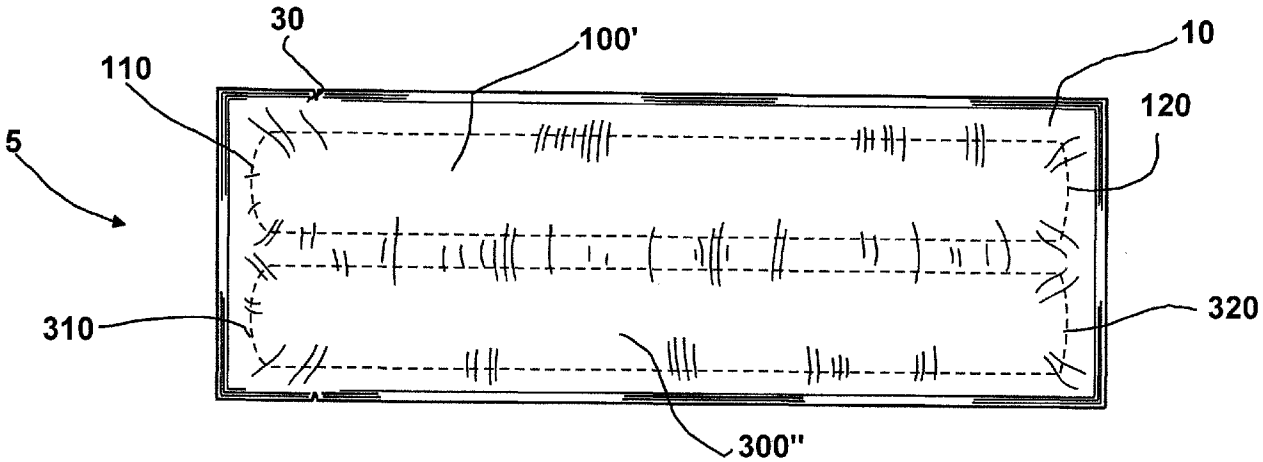
FIG. 11 is a top view of commercial packaging (e.g., foil pouch) containing two cigars or cigarillos, one having a large sized pull cord along its longitudinal centerline, and the other having a plurality of small sized pull cords along its longitudinal centerline.
Figure 12:
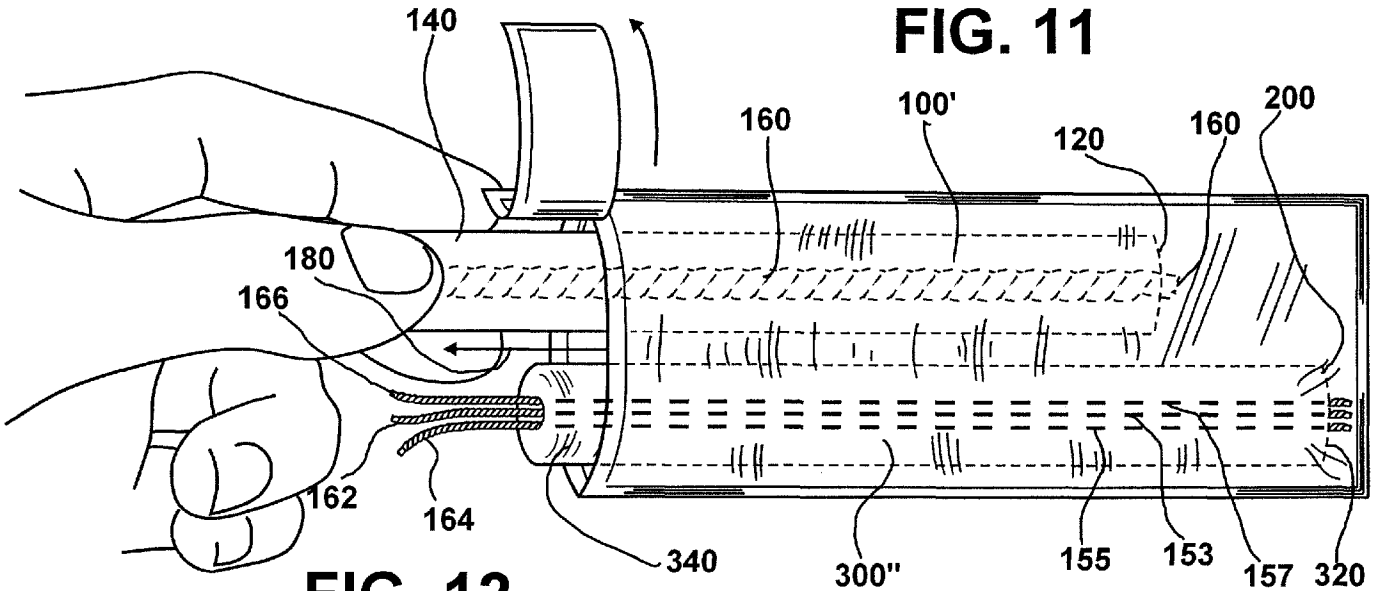
FIG. 12 shows the packaging of FIG. 11 in an opened condition and a user pulling out one of the cigars or cigarillos.
Figure 13:
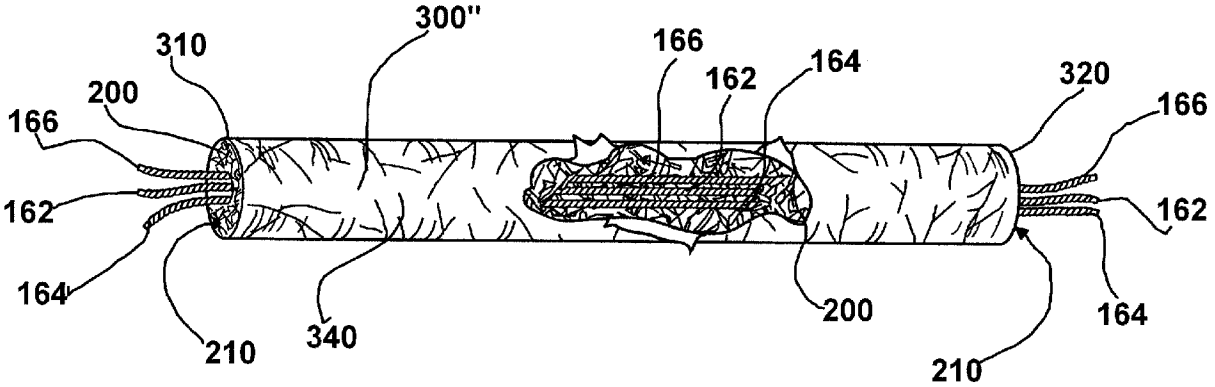
FIG. 13 shows one of the cigarillos of FIG. 11 removed from the packaging.

FIG. 11 is a top view of commercial packaging (e.g., foil pouch 10) containing two cigars or cigarillos 100',300', one having a large sized pull cord 160 along its longitudinal centerline, and the other having a plurality of small sized pull cords 162,164,166 along its longitudinal centerline. FIG. 12 shows the packaging 10 in an opened condition and a user pulling out one of the cigars or cigarillos. FIG. 13 shows one of the cigarillos 300' removed from the packaging 10.

Figure 14:
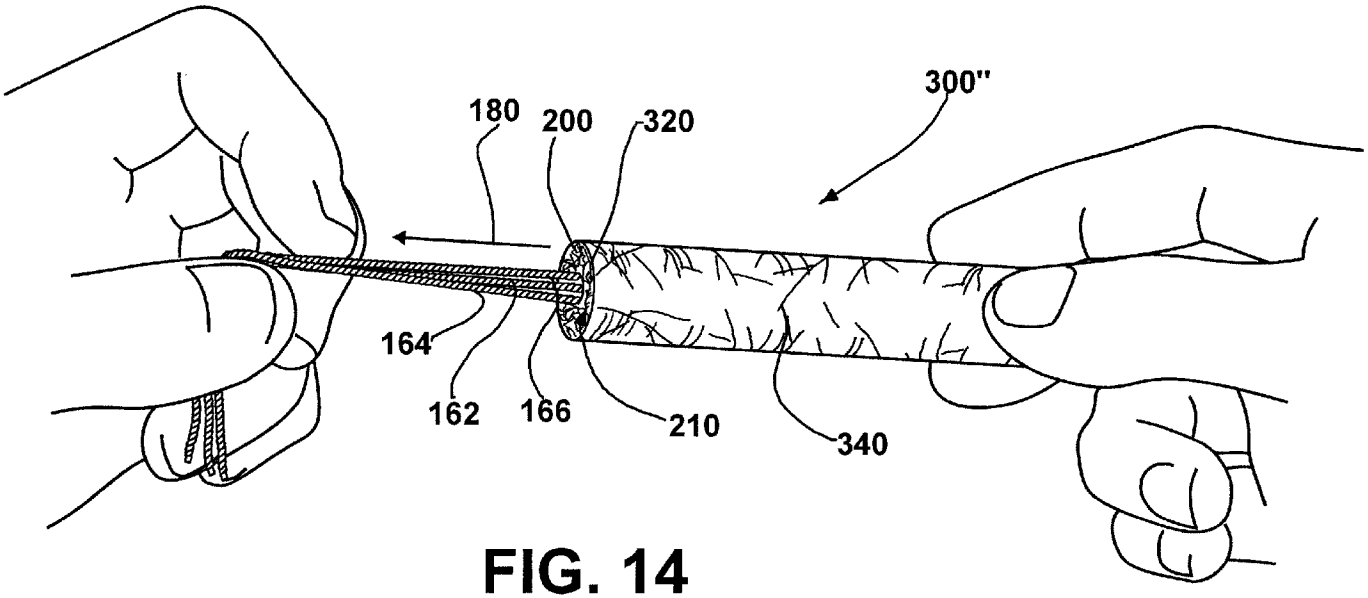
FIG. 14 shows the step of removing the plurality of small sized pull cords from the cigarillo of FIG. 13.
Figure 15:
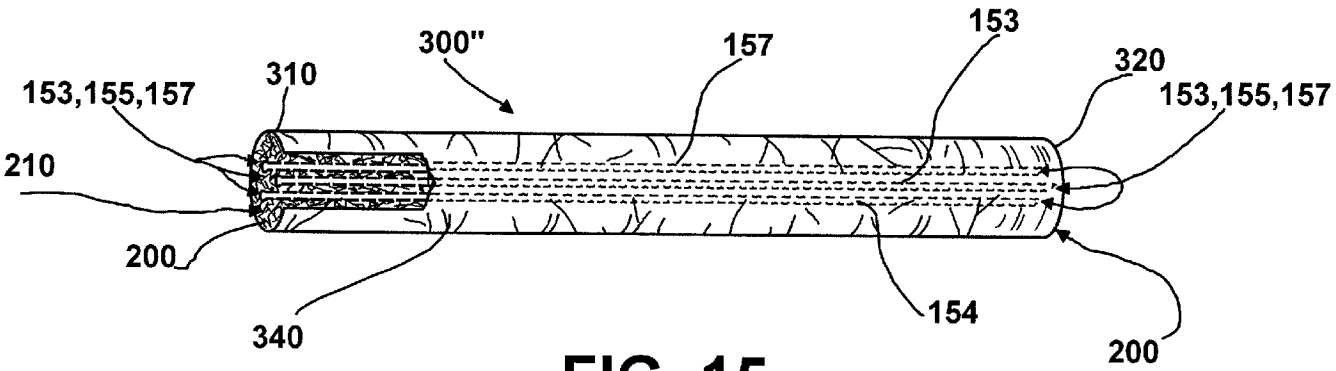
FIG. 15 shows one of the cigarillo of FIG. 14 having the plurality of small sized pull cords removed.
Figure 16:
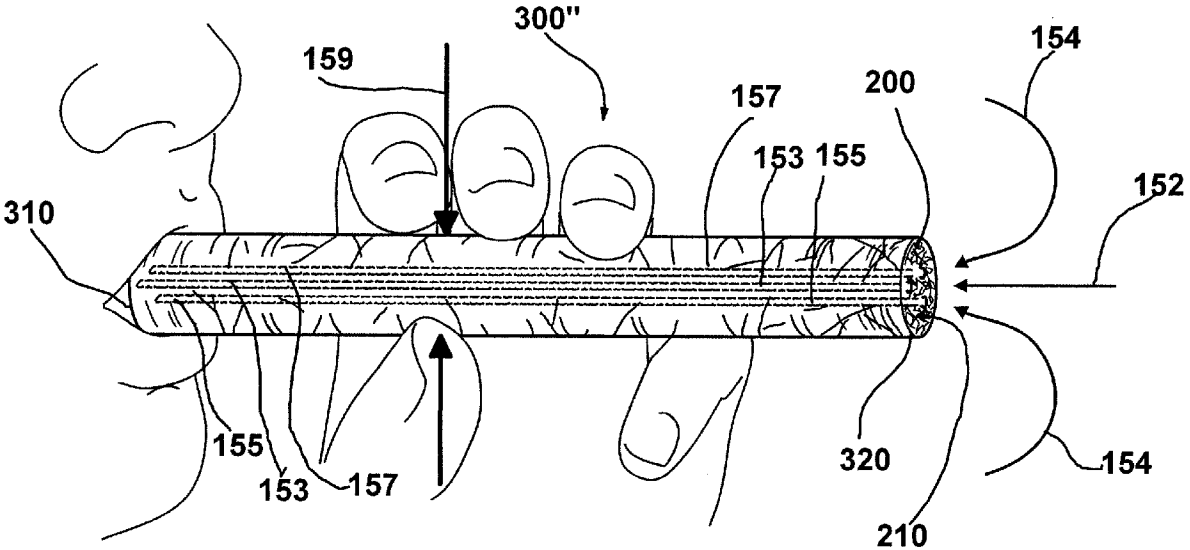
FIG. 16 shows the cigar or cigarillo lit with draw being impacted by the longitudinal opening after the large sized pull cord has been removed.

FIG. 14 shows the step of removing the plurality of small sized pull cords 162,164,166 from the cigarillo 300'. FIG. 15 shows cigarillo 300' having the plurality of small sized pull cords 162,164,166 removed. FIG. 16 shows the cigar or cigarillo 300' lit with draw being impacted by the longitudinal openings 153,155,157 after the plurality of small sized pull cords 162,164,166 were been removed. In one embodiment, less than all of the plurality of pull cords 162,164,166 can be removed. For example, pull cords 162, 164 can be removed and pull cord 166 remain. As another example, pull cord 162 can be removed and pull cords 164,166 remain. Removing less than all pull cords can also impact the draw as relatively less number of longitudinal bores are created. In these embodiments the remaining pull cords are preferably constructed of a smokable substance.

In FIG. 16 the relative resistance to air flow between annular bores 153,155,157 and annular tobacco area 210 can be changed be a user during smoking by squeezing on cigar 300' (schematically indicted by arrows 159) which will tend to decrease at one point along the longitudinal length of cigar 100' the sizes of longitudinal bores 153,155,157 while the resistance of annular area of tobacco 210 will be increased only a small amount or not at all. In this way the user can impact the draw of cigar 300' by changing the ratio of air drawn from longitudinal bores 153,155,157 (schematically indicated by arrow 152) relative to air drawn through annular tobacco area 210 (schematically indicated by arrows 154).

FIGS. 17-20 illustrate various steps in fabricating a cigar having a controlled burn rate. In one embodiment a cigar or cigarillo is comprised of a shell having a plurality if sheets containing a core made of tobacco filler.

It is believed that the relative burn rate of a cigar or cigarillo can be controlled based on a selected number of sheets used to form the shell.

It is believed that the relative burn rate of a cigar or cigarillo can be controlled based on the combination of type of sheets (such as whether natural leaf or homogenized tobacco) and/or changes in types of sheets which are concentrically rolled.

Figure 17:
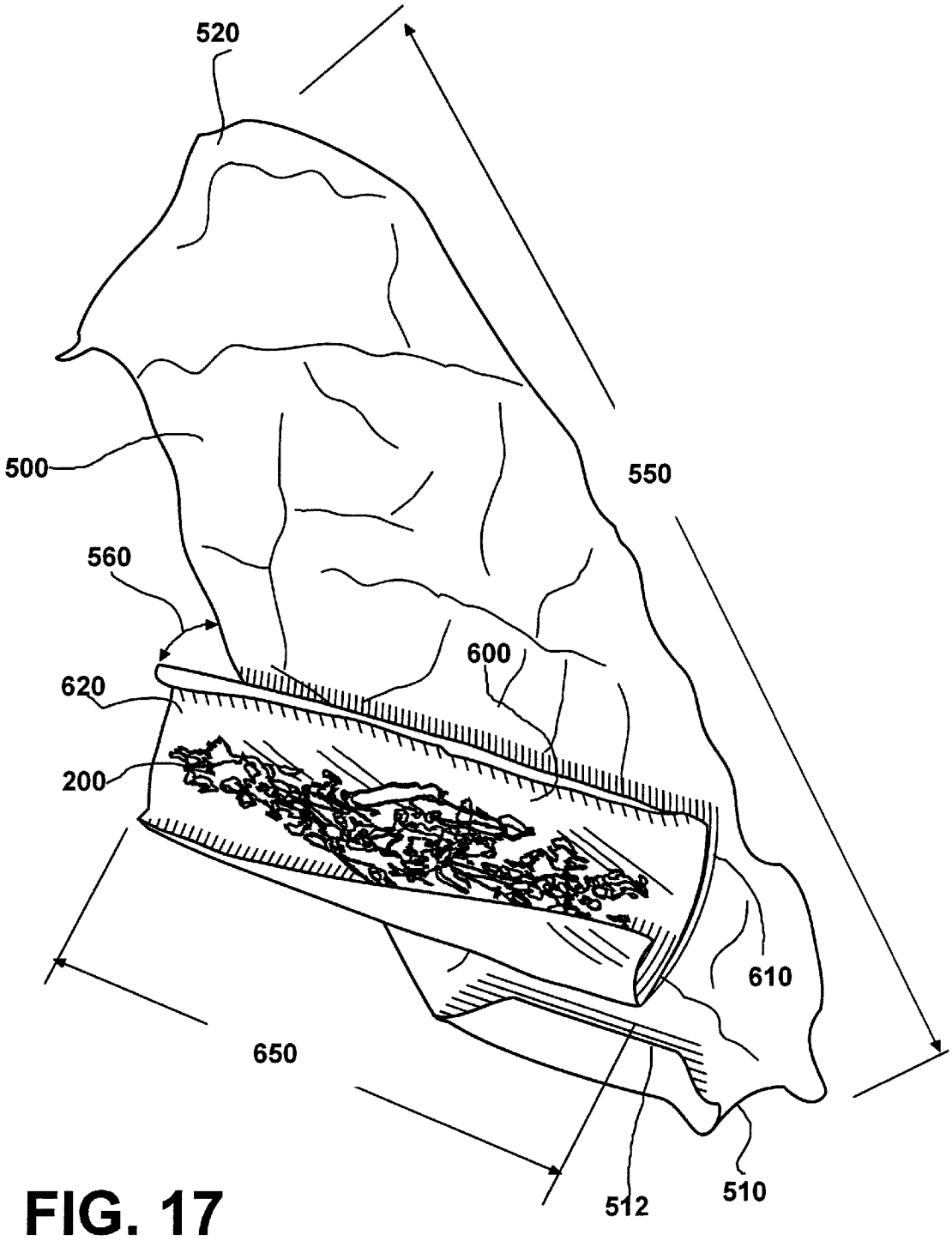
FIG. 17 is a perspective view showing a step in the method of making a cigar having a controlled burn rate.

FIG. 17 is a perspective view showing a step in the method of making a cigar 100 having a controlled burn rate. In FIG. 17 is shown a first sheet 500 which is a natural leaf sheet of length 550 and width, a second sheet 600, and tobacco filler 200. Second sheet can be of rectangular shape with a length 650 and a width. To assist in the rolling process second sheet 600 has been pre-rolled somewhat. In one embodiment length of second sheet 600 can be about the same as width of first sheet 500.

Second sheet 600 can be of a different type of material than first sheet 500. For example, second sheet 600 can be comprised of a homogenized tobacco material. In an alternative embodiment first sheet 500 can be homogenized tobacco material and second sheet 600 can be natural leaf material.

Second sheet 600 can be of rectangular shape with a length 650 and a width. To assist in the rolling process second sheet 600 has been pre-rolled somewhat. In one embodiment length of second sheet 600 can be about the same as width of first sheet 500. Second sheet 600 can be of a different type of material than first sheet 500. For example, second sheet 600 can be comprised of a homogenized tobacco material. I an alternative embodiment first sheet 500 can be homogenized tobacco material and second sheet 600 can be natural leaf material.

First sheet 500 is shown at an angular offset 560. Preferably, this angular offset should be between 15 to 75 degrees, 30 to 60 degrees, and most preferably 45 degrees.

Figure 18:
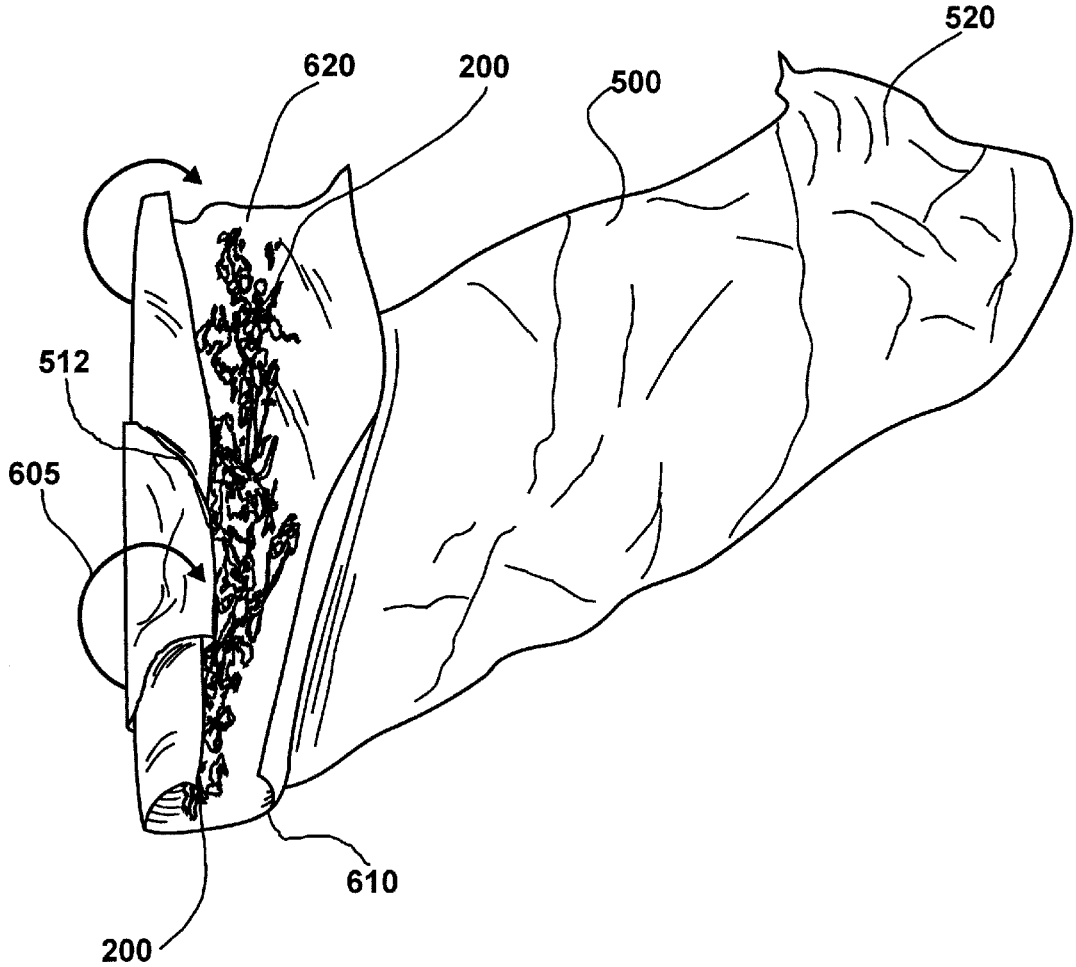
FIG. 18 is a perspective view showing another step in the method of making a cigar having a controlled burn rate.
Figure 19:
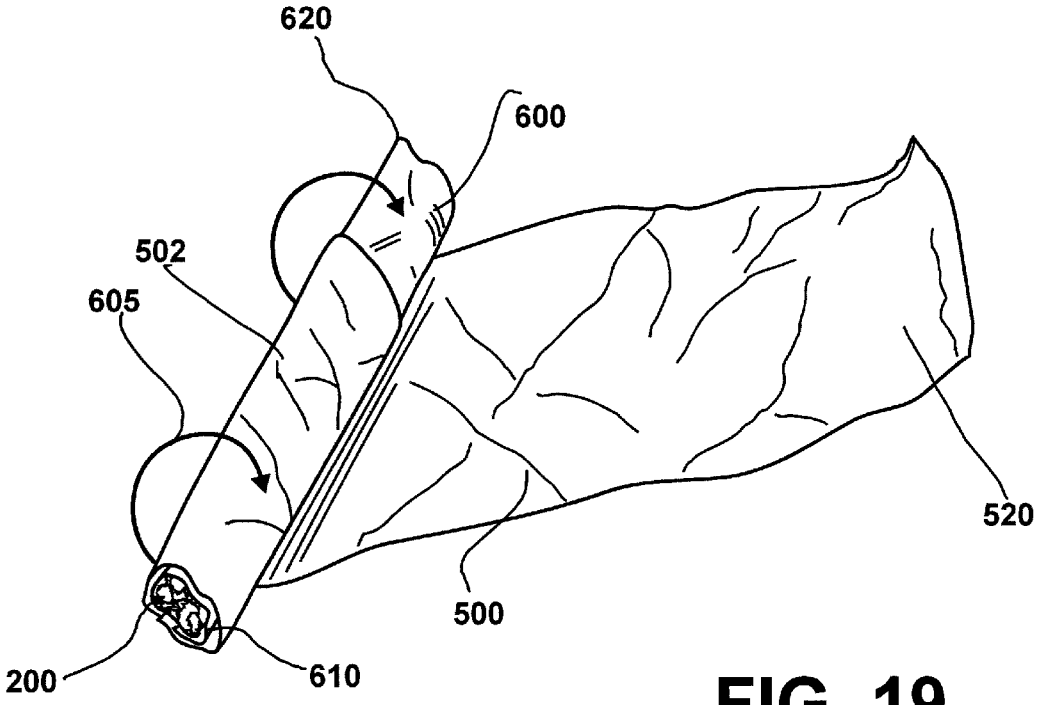
FIG. 19 is a perspective view showing another step in the method of making a cigar having a controlled burn rate.

Tobacco filler 200 can be placed on second sheet 600, and first sheet 500, second sheet 600, and tobacco filler 200 can be rolled as schematically shown in FIGS. 18 and 19, and indicated by arrows 605. FIG. 18 is a perspective view showing another step in the method of making a cigar having a controlled burn rate. FIG. 19 is a perspective view showing another step in the method of making a cigar having a controlled burn rate.

Figure 20:
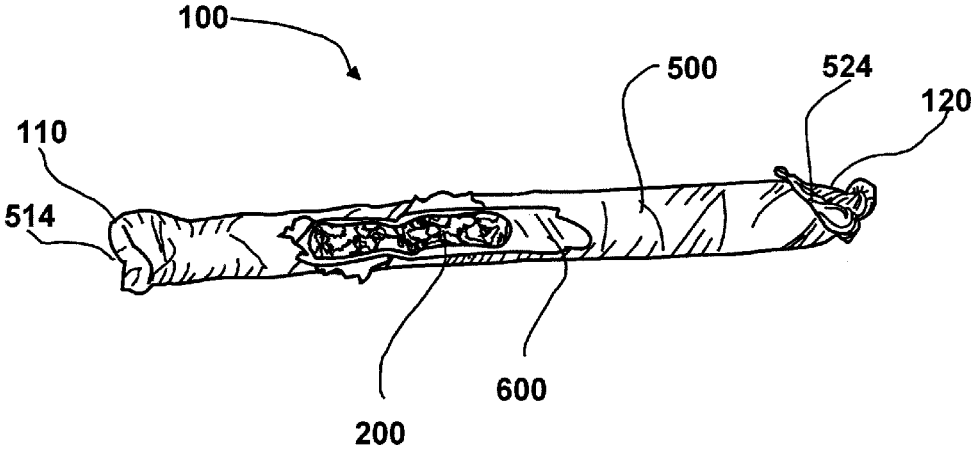
FIG. 20 is a perspective view showing a finished cigar having a controlled burn rate.

FIG. 20 is a perspective view showing a finished cigar 100 having a controlled burn rate, the rate of burn being a function of the number and type of sheets (e.g., 500,600) used to make the cigar 100. In FIG. 20 is shown a first sheet 500 which is a natural leaf sheet of length 550 and width, a second sheet 600, and tobacco filler 200. Cigar or cigarillo 100 can have twisted or pig-tailed end 524 on end 120, and folded end 514 on end 110.

Figure 21:
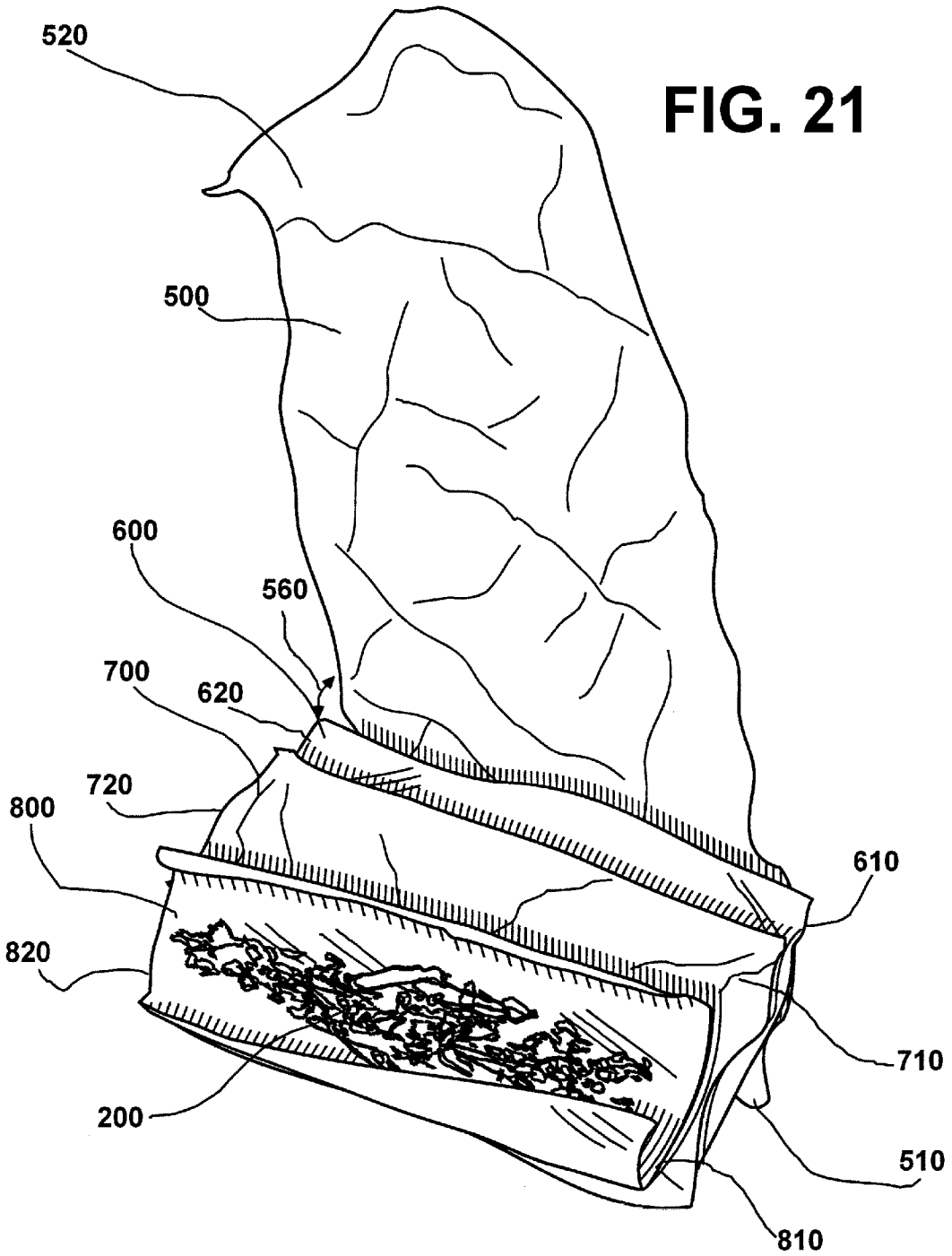
FIG. 21 is a perspective view showing a step in the method of making a cigar having a controlled burn rate, where the burn rate of the cigar or cigarillo is less than the burn rate of the cigar or cigarillo of FIG. 17.
Figure 22:
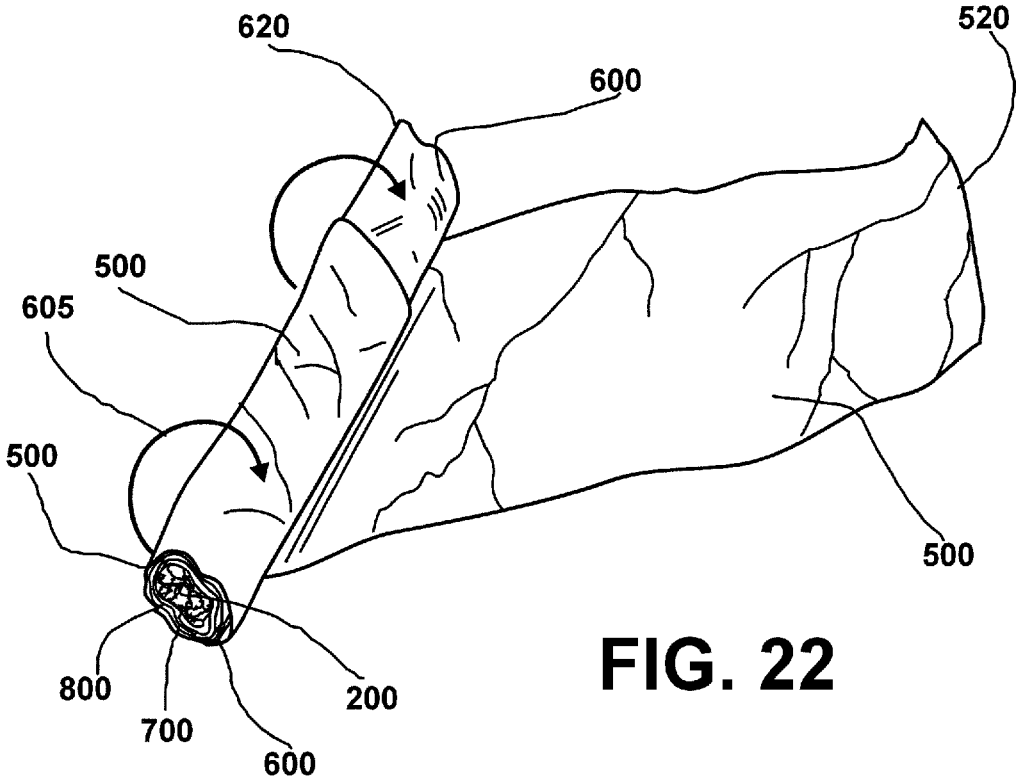
FIG. 22 is a perspective view showing another step in the method of making a cigar of FIG. 21 having a controlled burn rate.
Figure 23:
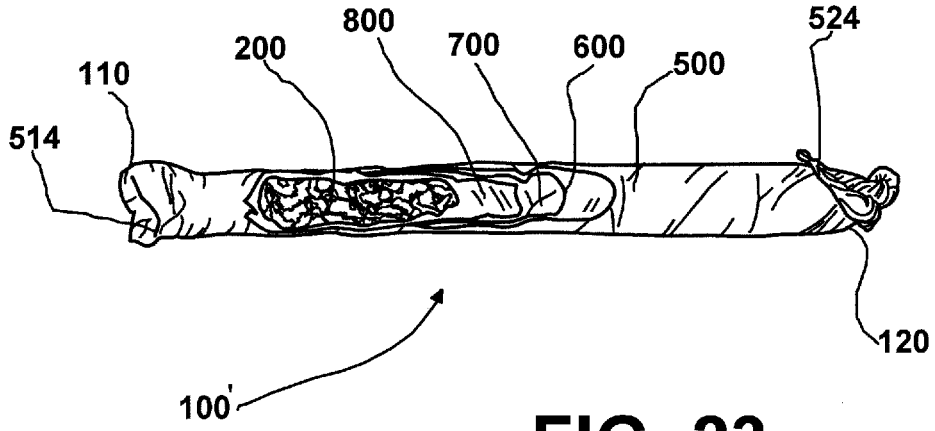
FIG. 23 is a perspective view showing a finished cigar or cigarillo of FIG. 21 having a controlled burn rate.

FIGS. 21-23 illustrate various steps in fabricating a cigar or cigarillo having a controlled burn rate, the burn rate being slower than the burn rate of the cigar or cigarillo of FIGS. 17-20. In one embodiment this slower burning cigar or cigarillo 100' is comprised of a shell having a plurality if sheets containing a core made of tobacco filler, the number of sheets being greater than the number of sheets in the faster burning cigar or cigarillo 100 of FIGS. 17-20.

First sheet 500 can be a natural leaf sheet of length 550 and width, a second sheet 600, and tobacco filler 200. First sheet 500 is shown at an angular offset 560. Preferably, this angular offset should be between 15 to 75 degrees, 30 to 60 degrees, and most preferably 45 degrees.

Second sheet 600 can be of rectangular shape with a length 650 and a width. To assist in the rolling process second sheet 600 has been pre-rolled somewhat. In one embodiment length of second sheet 600 can be about the same as width of first sheet 500. Second sheet 600 can be of a different type of material than first sheet 500. For example, second sheet 600 can be comprised of a homogenized tobacco material. In an alternative embodiment first sheet 500 can be homogenized tobacco material and second sheet 600 can be natural leaf material.

Third sheet 700 can be of rectangular shape with a length 750 and a width. To assist in the rolling process third sheet 700 has been pre-rolled somewhat. In one embodiment length of third sheet 700 can be about the same size (length and width) as second sheet 600. Third sheet 700 can be of a different type of material than second sheet 600. For example, third sheet 700 can be comprised of a natural leaf tobacco material. In an alternative embodiment first sheet 500 can be natural leaf, second sheet can be homogenized tobacco, and third sheet 700 can be natural leaf. In an alternative embodiment third sheet 700 can be of a similar type of material than second sheet 600. For example, third sheet 700 can be comprised of a homogenized tobacco material. In an alternative embodiment first sheet 500 can be natural leaf, second sheet can be homogenized tobacco, and third sheet 700 can be homogenized.

Fourth sheet 800 can be of rectangular shape with a length 850 and a width. To assist in the rolling process fourth sheet 800 has been pre-rolled somewhat. In one embodiment length of third sheet 700 can be about the same size (length and width) as second sheet 600 (or as third sheet 700). Fourth sheet 800 can be of a different type of material than second sheet 600 (and/or third sheet 700). For example, fourth sheet 800 can be comprised of a homogenized tobacco material. In an alternative embodiment first sheet 500 can be natural leaf, second sheet 600 can be homogenized tobacco, third sheet 700 can be natural leaf, and fourth sheet 800 can be natural leaf. In an alternative embodiment fourth sheet 800 can be of a similar type of material as third sheet 700. For example, fourth sheet 800 can be comprised of a homogenized tobacco material. In an alternative embodiment first sheet 500 can be natural leaf, second sheet 600 can be homogenized tobacco, third sheet 700 can be homogenized, and fourth sheet 800 can be homogenized tobacco.

First sheet 500 is shown at an angular offset 560. Preferably, this angular offset should be between 15 to 75 degrees, 30 to 60 degrees, and most preferably 45 degrees.

Tobacco filler 200 can be placed on second sheet 600, and first sheet 500, second sheet 600, third sheet 700, fourth sheet 800, and tobacco filler 200 can be rolled as schematically shown in FIG. 22 19, and indicated by arrows 605.

FIG. 22 is a perspective view showing a step in the method of making a cigar 100' having a relative controlled burn rate, the burn rate being slower than cigar or cigarillo 100 of FIGS. 17-20. Tobacco filler 200 can be placed on fourth sheet 800, and first sheet 500, second sheet 600, third sheet 700, fourth sheet 800, and tobacco filler 200 can be rolled as schematically shown in FIG. 22, and indicated by arrows 605. FIG. 23 is a perspective view showing a finished cigar or cigarillo 100'. Cigar or cigarillo 100' can have twisted or pig-tailed end 524 on end 120, and folded end 514 on end 110.

Figure 24:
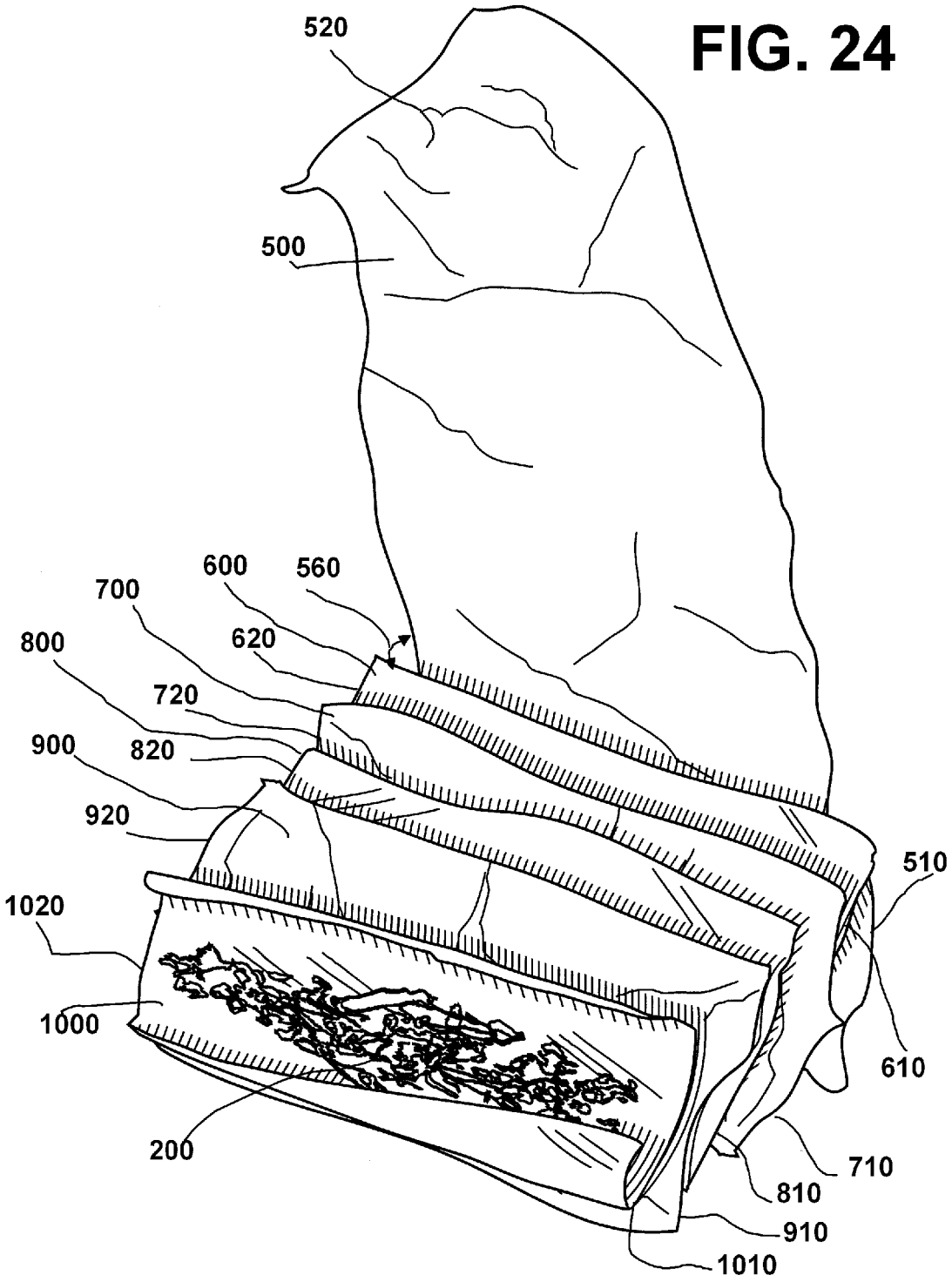
FIG. 24 is a perspective view showing a step in the method of making a cigar having a controlled burn rate, where the burn rate of the cigar or cigarillo is less than the burn rate of the cigars or cigarillos of FIGS. 17 and 21.
Figure 25:
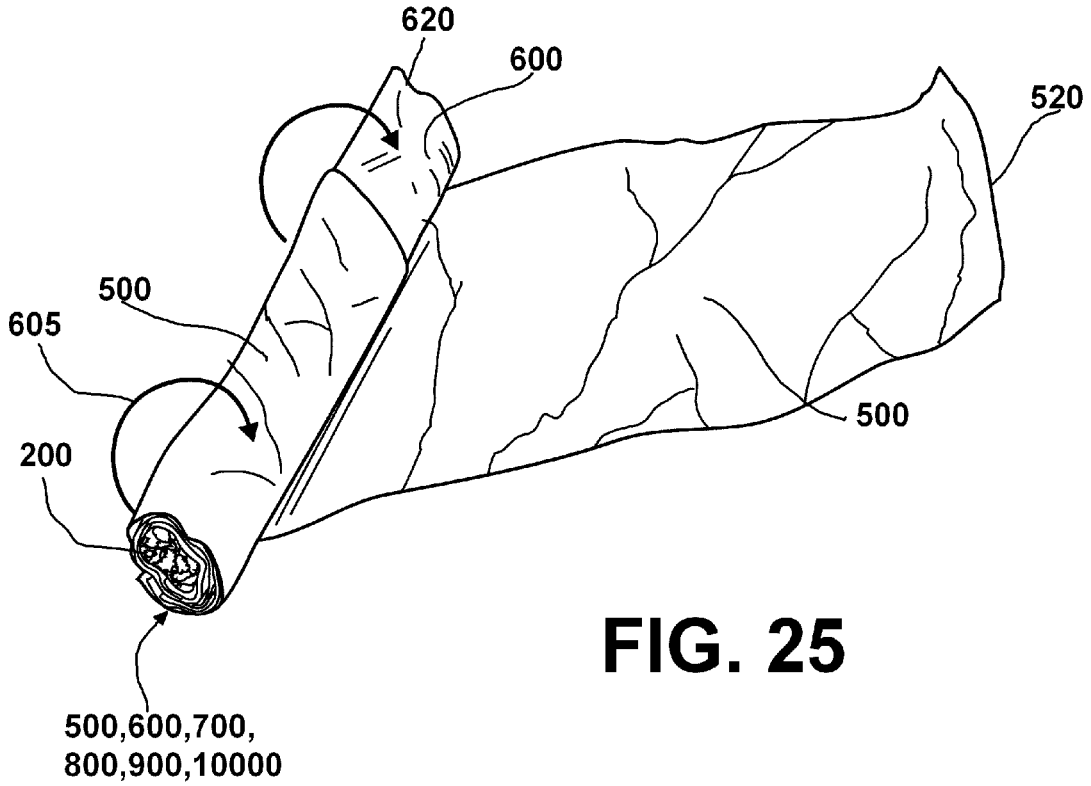
FIG. 25 is a perspective view showing another step in the method of making a cigar of FIG. 24 having a controlled burn rate.
Figure 26:
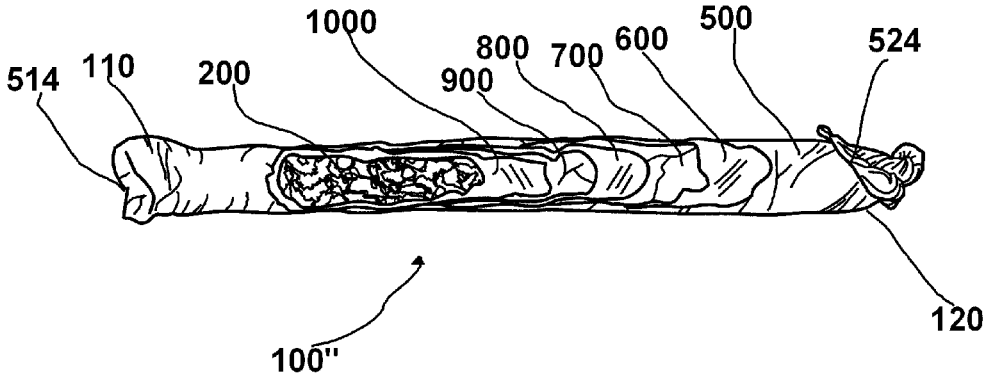
FIG. 26 is a perspective view showing a finished cigar or cigarillo of FIG. 21 having a controlled burn rate.

FIGS. 24-26 illustrate various steps in fabricating a cigar or cigarillo 100" having a controlled burn rate, the burn rate being slower than the burn rate of the cigar or cigarillo 100 of FIGS. 17-20, and cigar or cigarillo 100' of FIGS. 21-23. In one embodiment this slower burning cigar or cigarillo 100" is comprised of a shell having a plurality if sheets containing a core made of tobacco filler, the number of sheets being greater than the number of sheets in the faster burning cigar or cigarillo 100' of FIGS. 21-23 and cigar or cigarillo 100 of FIGS. 17-20.

First sheet 500 can be a natural leaf sheet of length 550 and width, a second sheet 600, and tobacco filler 200. First sheet 500 is shown at an angular offset 560. Preferably, this angular offset should be between 15 to 75 degrees, 30 to 60 degrees, and most preferably 45 degrees.

Second sheet 600 can be of rectangular shape with a length 650 and a width. To assist in the rolling process second sheet 600 has been pre-rolled somewhat. In one embodiment length of second sheet 600 can be about the same as width of first sheet 500. Second sheet 600 can be of a different type of material than first sheet 500. For example, second sheet 600 can be comprised of a homogenized tobacco material. In an alternative embodiment first sheet 500 can be homogenized tobacco material and second sheet 600 can be natural leaf material.

Third sheet 700 can be of rectangular shape with a length 750 and a width. To assist in the rolling process third sheet 700 has been pre-rolled somewhat. In one embodiment length of third sheet 700 can be about the same size (length and width) as second sheet 600. Third sheet 700 can be of a different type of material than second sheet 600. For example, third sheet 700 can be comprised of a natural leaf tobacco material. In an alternative embodiment first sheet 500 can be natural leaf, second sheet can be homogenized tobacco, and third sheet 700 can be natural leaf. In an alternative embodiment third sheet 700 can be of a similar type of material than second sheet 600. For example, third sheet 700 can be comprised of a homogenized tobacco material. In an alternative embodiment first sheet 500 can be natural leaf, second sheet can be homogenized tobacco, and third sheet 700 can be homogenized.

Fourth sheet 800 can be of rectangular shape with a length 850 and a width. To assist in the rolling process fourth sheet 800 has been pre-rolled somewhat. In one embodiment length of third sheet 700 can be about the same size (length and width) as second sheet 600 (or as third sheet 700). Fourth sheet 800 can be of a different type of material than second sheet 600 (and/or third sheet 700). For example, fourth sheet 800 can be comprised of a homogenized tobacco material. In an alternative embodiment first sheet 500 can be natural leaf, second sheet 600 can be homogenized tobacco, third sheet 700 can be natural leaf, and fourth sheet 800 can be natural leaf. In an alternative embodiment fourth sheet 800 can be of a similar type of material as third sheet 700. For example, fourth sheet 800 can be comprised of a homogenized tobacco material. In an alternative embodiment first sheet 500 can be natural leaf, second sheet 600 can be homogenized tobacco, third sheet 700 can be homogenized, and fourth sheet 800 can be homogenized tobacco.

Fifth sheet 900 can be of rectangular shape with a length 950 and a width. To assist in the rolling process fourth sheet 900 has been pre-rolled somewhat. In one embodiment length of fifth sheet 900 can be about the same size (length and width) as fourth sheet 800, third sheet 700, and/or second sheet 600. Fifth sheet 900 can be of a different type of material than fourth sheet 800, third sheet 700, and/or second sheet 600. For example, fifth sheet 900 can be comprised of a homogenized tobacco material. In an alternative embodiment first sheet 500 can be natural leaf, second sheet 600 can be homogenized tobacco, third sheet 700 can be natural leaf, fourth sheet 800 can be natural leaf, and fifth sheet 900 can be homogenized tobacco. In an alternative embodiment fifth sheet 900 can be of a similar type of material as fourth sheet 800, third sheet 700, and/or second sheet 600. For example, fifth sheet 900 can be comprised of a homogenized tobacco material. In an alternative embodiment first sheet 500 can be natural leaf, second sheet 600 can be homogenized tobacco, third sheet 700 can be homogenized, fourth sheet 800 can be homogenized tobacco, and fifth sheet 900 can be homogenized tobacco.

Sixth sheet 1000 can be of rectangular shape with a length 1050 and a width. To assist in the rolling process sixth sheet 1000 has been pre-rolled somewhat. In one embodiment length of sixth sheet 1000 can be about the same size (length and width) as fifth sheet 900, fourth sheet 800, third sheet 700, and/or second sheet 600. Sixth sheet 1000 can be of a different type of material than fifth sheet 900, fourth sheet 800, third sheet 700, and/or second sheet 600. For example, sixth sheet 1000 can be comprised of a homogenized tobacco material. In an alternative embodiment first sheet 500 can be natural leaf, second sheet 600 can be homogenized tobacco, third sheet 700 can be natural leaf, fourth sheet 800 can be natural leaf, fifth sheet 900 can be homogenized tobacco, and sixth sheet 1000 can be natural leaf.

First sheet 500 is shown at an angular offset 560. Preferably, this angular offset should be between 15 to 75 degrees, 30 to 60 degrees, and most preferably 45 degrees.

Tobacco filler 200 can be placed on sixth sheet 1000, and first sheet 500, second sheet 600, third sheet 700, fourth sheet 800, fifth sheet 900, and sixth sheet 1000, along with tobacco filler 200 can be rolled as schematically shown in FIGS. 24 and 25, and indicated by arrows 605.

FIG. 25 is a perspective view showing a step in the method of making a cigar or cigarillo 100" having a relative controlled burn rate, the burn rate being slower than cigar or cigarillo 100 of FIGS. 17-20 and cigar or cigarillo 100' of FIGS. 21-23. Tobacco filler 200 can be placed on sixth sheet 1000, and first sheet 500, second sheet 600, third sheet 700, fourth sheet 800, fifth sheet 900, and sixth sheet 1000, and tobacco filler 200 can be rolled as schematically shown in FIG. 25, and indicated by arrows 605. FIG. 26 is a perspective view showing a finished cigar or cigarillo 100". Cigar or cigarillo 100" can have twisted or pig-tailed end 524 on end 120, and folded end 514 on end 110.

In various embodiments different numbers of sheets of material of different materials can be similarly used in manufacturing cigars of relative controlled burn rates. In different embodiments the number of sheets can vary between 2, 3, 4, 5, 6, 7, 8, 9, 10, 12, 14, 16, 18, 20, 22, 24, 26, 28, and 30. In different embodiments the numbers of sheets can be a range between any two of the above referenced numbers of sheets.

In different embodiments combinations of sheets made of different smoking materials, such as homogenized tobacco paper, natural leaf, rolling paper, and/or sheets of other smokable materials can be used in manufacturing cigars or cigarillos of controlled burned rates. One embodiment includes possible combinations of the different types of sheets of homogenized tobacco paper, natural leaf, rolling paper, and/or sheets of other smokable materials. One embodiment includes sheets comprised of different smokable materials chosen from any combination of the following types of materials: natural leaf, homogenized tobacco paper, pipe tobacco, different types of flavored tobacco, tea leaves, kanna, blue lotus, *salvia, salvia* eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, *Leonurus* Sibericus Flowers, Wild Dagga Flowers, Klip Dagga Leaf, Damiana, Hookah, *Hemia salicifolia*, Kava Kava, *Avena Sativa*, scotch broom topps, Valarian, capillarius, herba, Wild clip dagga, *Leonurus sibiricus*, Kanna, Sinicuichi, and/or *lactuca virosa*.

Figure 27:
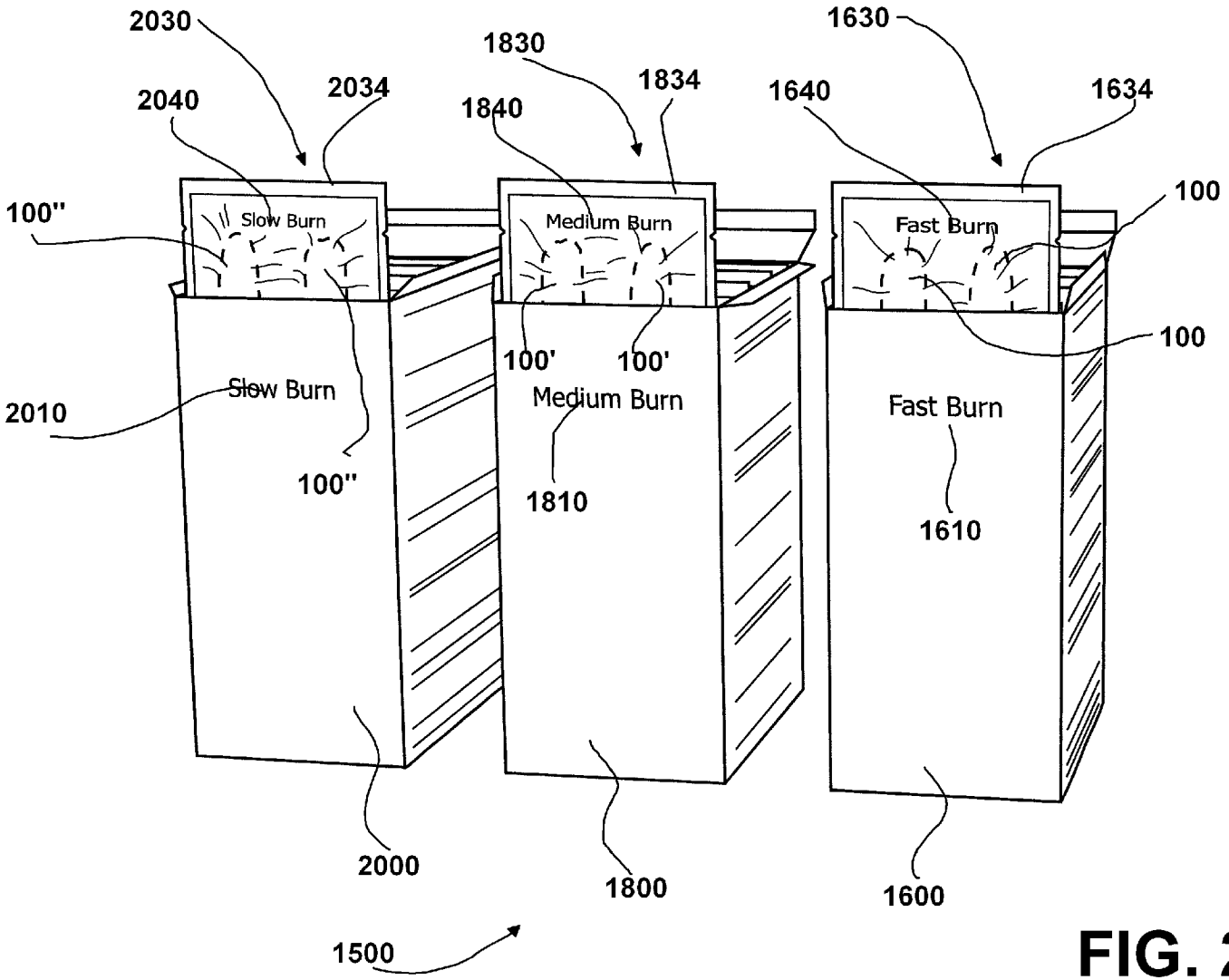
FIG. 27 is a perspective view of a point of sale area for cigars or cigarillos packaged for sale using the cigars or cigarillos of FIGS. 17, 21, and 24 labeling them respectively fast, medium, and slow burning on the commercial packaging.

One embodiment includes a method of offering for sale cigars or cigarillos having different relative burn rates. In one embodiment a plurality of commercial packages are offered at a point of sale the plurality of commercial packaging having a plurality of indicia of differing burn rates for the cigars or cigarillos being offered to consumers. FIG. 27 is a perspective view of a point of sale area 1500 for cigars or cigarillos 100, 100', and 100" packaged for sale using the cigars or cigarillos of FIGS. 17, 21, and 24 labeling them respectively fast 1610, medium 1810, and slow 2010 burning on the commercial packaging.

In one embodiment a pouch containing a plurality of cigars or cigarillos are offered for sale, the cigars or cigarillos being marketed as having different burn rates. In one embodiment the different burn rates can be indicated relative to each other at the point of sale 1500. For example, the differing burn rates can be "slow" and "fast". As another example, the different burn rates can be indicated as "slow"; "medium" and "fast" burn.

In one embodiment cigars or cigarillos are marketed as having different burn rates where the cigars or cigarillos of similar burn rates are placed adjacent to each other, such that a consumer can select at the time of purchase a particular cigar or cigarillo of having the consumer's preferred burn rate. In one embodiment at least two different burn rates are marketed side by side (for example, slow or fast burn). In one embodiment at least three different burn rates are marked side by side (for example, slow, medium, or fast burn).

The following is a list of reference numerals which are used in this application.

LIST OF REFERENCE NUMERALS

| Reference Number | Description |
|---|---|
| 5 | cigar article or tobacco product |
| 10 | package |
| 20 | resealable closure |
| 30 | tear notch |
| 40 | package interior |
| 100 | first cigar |
| 110 | first end portion |
| 114 | folded portion |
| 120 | second end portion |
| 124 | twisted or pig-tailed portion |
| 130 | filler |
| 140 | outer sheet or layer (e.g., binder/wrapper) |
| 150 | longitudinal opening |
| 152 | arrow |
| 153 | longitudinal opening |
| 154 | arrows |
| 155 | longitudinal opening |
| 157 | longitudinal opening |
| 159 | arrows |
| 160 | form casing or straw |
| 170 | arrow |
| 180 | arrow |
| 190 | arrow |
| 200 | tobacco filler |
| 300 | second cigar |
| 310 | first end portion |
| 320 | second end portion |
| 330 | filler |
| 340 | outer sheet or layer (e.g., binder/wrapper) |
| 350 | longitudinal opening |
| 360 | form casing or straw |
| 380 | arrow |
| 390 | arrow |
| 400 | tobacco filler |
| 500 | sheet |
| 504 | arrow |
| 510 | first end |
| 512 | wrapping edge |
| 520 | second end |
| 550 | length |
| 560 | angular offset |
| 600 | sheet |
| 610 | first end |
| 620 | second end |
| 650 | length |
| 700 | sheet |
| 710 | first end |
| 720 | second end |
| 800 | sheet |
| 810 | first end |
| 820 | second end |
| 900 | sheet |
| 910 | first end |
| 920 | second end |

-continued

LIST OF REFERENCE NUMERALS

| Reference Number | Description |
|---|---|
| 1000 | sheet |
| 1010 | first end |
| 1020 | second end |
| 1500 | point of sale |
| 1600 | first carton |
| 1610 | indicia of relative burn rate |
| 1630 | plurality of pouches |
| 1634 | pulled out pouch |
| 1640 | indicia of relative burn rate |
| 1650 | plurality fast burning cigars or cigarillos |
| 1800 | second carton |
| 1810 | indicia of relative burn rate |
| 1830 | plurality of pouches |
| 1834 | pulled out pouch |
| 1840 | indicia of relative burn rate |
| 1850 | plurality fast burning cigars or cigarillos |
| 2000 | third carton |
| 2010 | indicia of relative burn rate |
| 2030 | plurality of pouches |
| 2034 | pulled out pouch |
| 2040 | indicia of relative burn rate |
| 2050 | plurality fast burning cigars or cigarillos |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of marketing a plurality of cigars or cigarillos to a consumer comprising the steps of:

(a) providing a point of sale display;

(b) the display providing sets of cigars or cigarillos having different burn rates which are packaged for sale, wherein each set includes multiple cigars or cigarillos;

(c) packaging the first set of cigars or cigarillos having a first burn rate in a first package, the first package having a first indicia indicating the first burn rate; and (d) packaging the second set of cigars or cigarillos having a second burn rate in a second package, the second package having a second indicia indicating the second burn rate, the second burn rate being slower than the first burn rate;

(e) wherein the display enables the consumer to select either the first or the second package;

f) wherein each cigar or cigarillo has an outer shell filled with smokable tobacco filler and one or more elongated members imbedded in said smokable tobacco filler; and g) wherein each elongated member can be removed to provide an air flow path spaced inwardly of said outer shell that increases the burn rate.

2. The method of claim 1, wherein the first set of cigars are packaged in cartons and the cartons include the first indicia, and the second set of cigars are packaged in cartons and the cartons include the second indicia.

3. The method of claim 1, wherein the first set of cigars are packaged in pouches and the pouches include the first indicia, and the second set of cigars are packaged in pouches and the pouches include the second indicia.

4. The method of claim 1, further comprising the step of having the packaging for a third set of cigars or cigarillos having a third burn rate and having a third indicia on such packaging indicating the third burn rate, the third burn rate being slower than the second burn rate.

5. The method of claim 4, wherein the first set of cigars are packaged in pouches and the pouches include the first indicia, and the second set of cigars are packaged in pouches and the pouches include the second indicia, and the third set of cigars are packaged in pouches and the pouches include the third indicia.

6. A method of marketing a plurality of cigars or cigarillos to a consumer comprising the steps of:

(a) providing a plurality of cigars or cigarillos, each having an outer shell surrounding a mass of smokable tobacco material and one or more elongated members imbedded in said mass of smokable tobacco material;

(b) packaging the plurality of cigars or cigarillos in a package;

(c) providing indicia on the package indicating an initial burn rate for the cigars and cigarillos;

(d) marketing the package on a display that enables the consumer to view the indicia on the package; and (e) wherein each elongated member can be removed to provide an air flow path that is spaced inwardly of said outer shell and that increases the burn rate.

7. The method of claim 6 wherein the package is a carton and the carton includes the indicia.

8. The method of claim 6 wherein the package is a pouch and the pouch includes the indicia.

9. The method of claim 6 wherein each elongated member has a length that is about the same length as the cigar or cigarillo.

10. The method of claim 6 wherein the package contains cigars and cigarillos having different initial burn rates.

11. The method of claim 6 wherein each elongated member is of a combustible material.

12. The method of claim 6 wherein each elongated member is an elongated cable.

13. A method of marketing a plurality of cigars or cigarillos to a consumer comprising the steps of:

(a) providing a plurality of cigars or cigarillos, each having an outer shell surrounding a mass of smokable tobacco material and one or more elongated members imbedded in said mass of smokable tobacco material;

(b) packaging the set of cigars or cigarillos in a package, each cigar or cigarillo having an initial burn rate;

(c) providing indicia on the package indicating the initial burn rate for the cigars and cigarillos;

(d) marketing multiple of said packages on a display that includes indicia that informs the consumer how to adjust the burn rate by removal of the elongated member; and (e) wherein each elongated member can be removed to provide an air flow path spaced inwardly of said outer shell and that increases the burn rate.

14. The method of claim 13 wherein there are multiple said packages, each one or more packages have cigar or cigarillos with a burn rate which differs from the burn rate of cigars or cigarillos in another said package.

15. The method of claim 13 wherein the package is a carton and the carton includes the indicia.

16. The method of claim 13 wherein the package is a pouch and the pouch includes the indicia.

17. The method of claim 13 wherein each elongated member has a length that is about the same length as the cigar or cigarillo.

18. The method of claim 13 wherein each elongated member is of a combustible material.

19. The method of claim 13 wherein each elongated member is an elongated cable.

* * * * *